US005381612A

United States Patent [19]

Paris

[11] Patent Number: 5,381,612

[45] Date of Patent: Jan. 17, 1995

[54] DEVICE FOR BLOCKING AN UPPER OF A SKI BOOT

[75] Inventor: Jean Paris, Sevrier, France

[73] Assignee: Salomon S.A., Metz-Tessy, France

[21] Appl. No.: 79,138

[22] Filed: Jun. 21, 1993

[30] Foreign Application Priority Data

Jun. 22, 1992 [FR] France ..... 92 07762

[51] Int. Cl.[6] ..... A43B 5/04

[52] U.S. Cl. ..... 36/117; 36/119; 36/120; 36/121

[58] Field of Search ..... 36/117, 118, 119, 120, 36/121

[56] References Cited

U.S. PATENT DOCUMENTS

| | | | |
|---|---|---|---|
| 4,711,042 | 12/1987 | Morell et al. | 36/117 |
| 4,761,899 | 8/1988 | Marxer | 36/121 |
| 4,893,419 | 1/1990 | Arieh et al. | 36/119 |
| 4,945,660 | 8/1990 | Perrissound | 36/117 |
| 5,001,849 | 3/1991 | Bidoia | 36/117 |
| 5,003,711 | 4/1991 | Nerrinck et al. | 36/117 |
| 5,065,530 | 11/1991 | Pozzobon et al. | 36/50 |
| 5,191,728 | 3/1993 | Paris et al. | 36/121 |

FOREIGN PATENT DOCUMENTS

| | | | |
|---|---|---|---|
| 0248149 | 12/1987 | European Pat. Off. | A43B 5/04 |
| 0278245 | 8/1988 | European Pat. Off. | A43B 5/04 |
| 0307349 | 3/1989 | European Pat. Off. | A43B 5/04 |
| 0370363 | 5/1990 | European Pat. Off. | A43C 11/16 |
| 0375604 | 6/1990 | European Pat. Off. | A43B 5/04 |
| 0470383 | 2/1992 | European Pat. Off. | A43B 5/04 |
| 1448831 | 7/1966 | France . | |
| 2643795 | 9/1990 | France | A43B 5/04 |
| 2657235 | 7/1991 | France | A43B 5/04 |
| 2657506 | 8/1991 | France | A43B 5/04 |
| 2661076 | 10/1991 | France | A43B 5/04 |
| 3506056 | 3/1986 | Germany | 36/117 |
| 1187443 | 12/1987 | Italy . | |

*Primary Examiner*—Paul T. Sewell
*Assistant Examiner*—Marie Denise Patterson
*Attorney, Agent, or Firm*—Sandler Greenblum & Bernstein

[57] ABSTRACT

An alpine ski boot having a shell base on which is journalled at least partially an upper constituted of at least one rear spoiler and a front cuff, the rear spoiler being journalled with respect to the shell base about a transverse axis and including a tensioning lever acting in traction on at least one flexible and inextensible link inserted between a front mobile portion of the boot to be controlled during tightening on a portion of the lower part of the leg or foot and the lever, such lever acting also on an element for reclaiming rear support of the upper on shell base wherein the element for reclaiming rear support is constituted by at least one second flexible and inextensible link, distinct from the first, inserted between the same tensioning lever and a fixed portion of the shell base, such that the latching action of the tensioning lever causes, by a simultaneous traction on the two links, both tightening control of the front mobile portion of the boot so as to fulfill a first function, and the reclaiming of rear support of the upper on the shell base, without an intermediate element, so as to fulfill a second function.

21 Claims, 5 Drawing Sheets

8A
16A
1A
25
14
F3
e1
E
e
α
16A
15A
26
7
9A
F2
3A
20
4A
22
21b
21a
24
23
21
E
2A

8 B
14
F3
e1
E
e
25
15 B
26
7
30
3B
4B
24
20
21
E
2B
α

DEVICE FOR BLOCKING AN UPPER OF A SKI BOOT

BACKGROUND OF THE INVENTION

1. Field of the Invention

The present invention is related to an alpine ski boot comprising a shell base on which is at least partially journalled an upper constituted by at least one rear spoiler and a front cuff, the rear spoiler being journalled with respect to the shell base about a transverse axis and comprising a tensioning lever exerting a traction on at least one flexible and nonextensible link inserted between a front mobile portion of the boot to be controlled by tightening a part of the lower part of the leg or the foot and the lever, such lever also exerting an action on an element for restoring rear support of the upper on the shell base.

2. Discussion of Background and Relevant Information

Such means exerting a tightening action both on a portion of the boot and on an element for restoring rear support are known by the French Patent Publication No. 2,657,235.

In that application, a support element is described, which is journalled on an axis of the rear spoiler and adapted to be placed in support on a support portion of the shell base, when the boot is closed. This support element is driven into the working position by the end of the lever during its movement towards a closure position of the boot, against the elastic return means.

This device has a certain number of disadvantages due to the presence of the support element itself, which is controlled by the lever and which in fact constitutes an intermediate element to be attached on the rear spoiler. This constitutes an additional element to be manufactured and positioned in place, and requires, in addition, a very precise adjustment of the elements that have to cooperate with respect to each other, whereas the elements that support them are relatively flexible, therefore deformable.

This can result in an accidental unlatching of the boot for the two functions cited herein above and can result in the user falling down.

The French Patent Publication No. 2,643,795 also discloses a tensioning lever acting on a cable interposed between a fixed point of the shell base and a point of the rear spoiler on which the cable acts due to the action of the lever.

The pivoting thereof immobilizes the rear spoiler and consequently the front cuff which is then capable of being affixed to it. The upper constituted in this way, offers an efficient restoration of rear support along a certain angle of advance with respect to the shell base, but it complicates the construction of the boot generally, because the closure means annexed to the front cuff on the rear spoiler, thus immobilized, must be envisioned and put into position. Unless, it is related to the positioning of internal tightening means of the foot as described in the Italian Patent No. 1,187,443.

This patent discloses a control lever acting on two cables, one in connection with an internal tightening plate of the foot, and the other with the front cuff which it drives while tightening on the rear spoiler for latching on the lower part of the leg of the skier.

Here, restoring support is done on the upper at an upper portion pivoting about a journalled axis whereas the other cable takes support on a mobile foot retention assembly.

This does not offer a positive rear support because the entire device is mounted on journalled elements.

SUMMARY OF THE INVENTION

It is an object of the present invention to overcome all these disadvantages and is related, to this end, to an alpine ski boot comprising a shell base on which is at least partially journalled an upper constituted of at least one rear spoiler and one front cuff, the rear spoiler being journalled with respect to the shell base about a transverse axis and comprises a tensioning lever acting in traction on at least one flexible and inextensible link inserted between a front mobile portion of the boot to be controlled in tightening on a portion of the lower part of the leg or of the foot and the lever, such lever also acting on an element for restoring rear support of the upper on the shell base wherein the element for restoring rear support is constituted by at least a second flexible and inextensible link, separate from the first inserted between the same tensioning lever and a fixed portion of the shell base, such that the latching activation of the tensioning lever causes, by simultaneous traction on the two links, both the tightening control of the front mobile portion of the boot as well as restoring rear support of the upper on the shell base, without an intermediate element.

BRIEF DESCRIPTION OF THE DRAWINGS

The invention will be better understood and other characteristics thereof will become more apparent upon reading the description that follows, with reference to the annexed schematic drawings, illustrating as a non-limiting example, how the invention can be obtained and wherein.

DETAILED DESCRIPTION OF THE PREFERRED EMBODIMENTS

Figure 1:
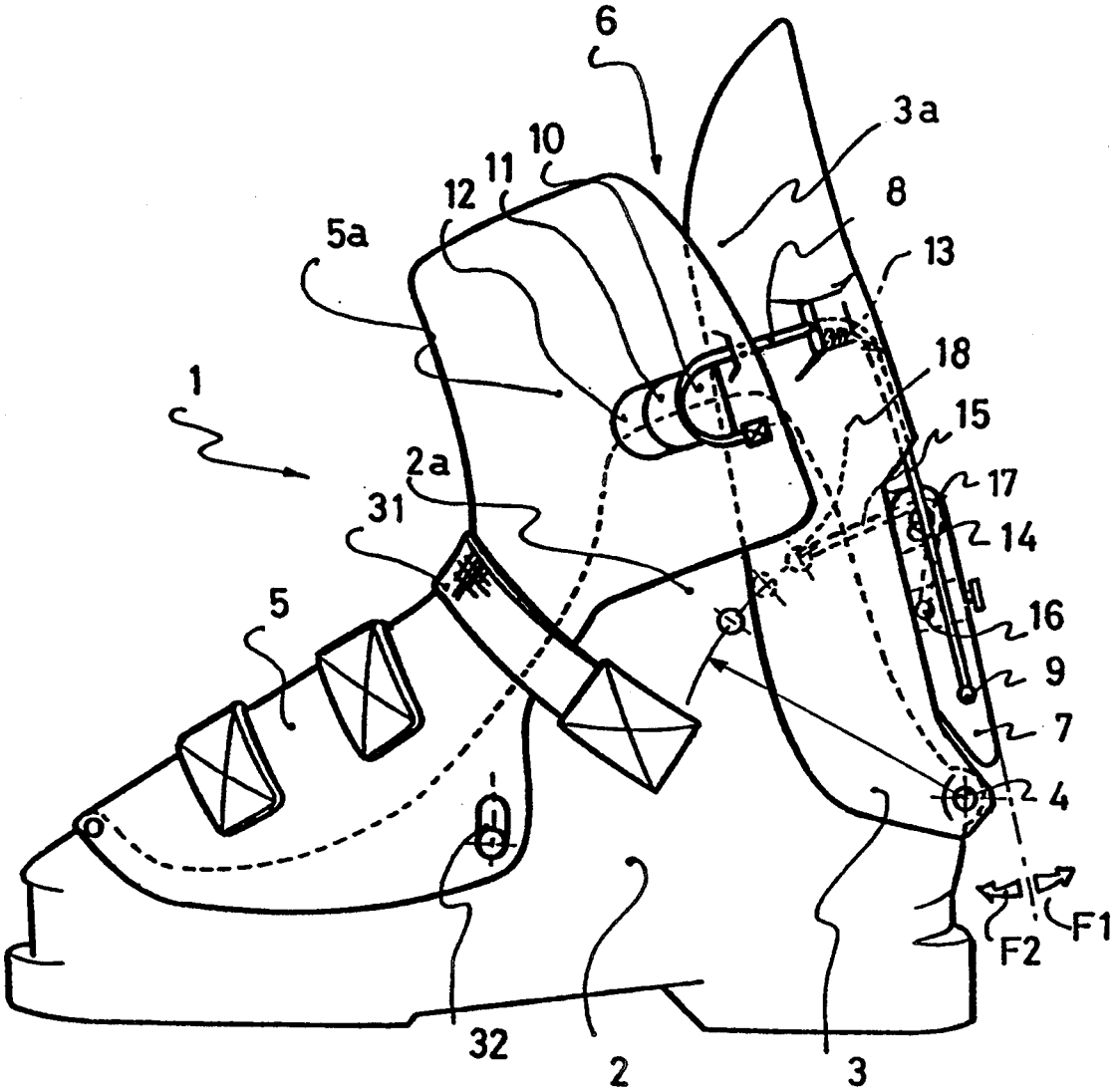
FIG. 1 is a side view of the ski boot comprising a tightening device of the upper and rear support restoring device thereof, as per a first embodiment of the invention.

As an illustrative though non-limiting example, the boot 1 is generally provided with the reference numeral 1 and is represented in FIG. 1. It comprises a shell base 2 on the rear portion of which a rear spoiler 3 is journalled about a transverse axis 4 and on the front portion of which boot is journalled a front cuff 5, the front cuff 5 and rear spoiler 3 cooperating to constitute the upper 6 of boot 1. Upper 6 is adapted to envelope the lower part of the leg of the user by lateral wings 5*a* of front cuff 5 and 3*a* of rear spoiler 3, whose dimensions are such so as to enable their overlapping during tightening via appropriate means.

Such means are constituted by a tensioning lever 7 acting in traction on two flexible and inextensible links 8 located symmetrically on either side of the lateral wings 3*a*, 5*a* of spoiler 3 and cuff 5 of upper 6.

Links 8 are arranged in connection, on the one hand with tensioning lever 7 on anchoring points 9 located on either side thereof, and on the other hand, on one of a plurality of anchoring points 10, 11, 12 obtained on wings 5*a* of front cuff 5. The tightening links 8 thus arranged also take support in the guide channels constituted by the angle return plugs 13 obtained on the rear spoiler 3 and thus drive the rear spoiler 3 and front cuff 5 towards one another during a traction exerted by lever 7 during a rotation about its axis 14. This axis 14 is arranged transversely on a rear portion of spoiler 3 and enables an angular movement of the lever 7, along F1 for controlling loosening of links 8 and along F2 for controlling tightening of the same links 8.

As can also be seen from FIG. 1, tensioning lever 7 is also designed to act on an element for restoring rear support of upper 6 on shell base 2.

This element is constituted as per the invention by two second links 15, also flexible and inextensible, separate from first links 8, and inserted between the same tensioning lever 7 and a fixed portion 18 of shell base 2.

In this way, the latching action of tensioning lever 7 along F2 causes, by a simultaneous traction on links 8 and 15, both tightening control of the front mobile portion 5 of boot 1, specifically the front cuff 5, for a first function ensured by the invention, and restoring of rear support of upper 6 on shell base 2, without an intermediate element, for a second function of the invention. The rear support function is directed to the blocking or securing of the upper 6, or the rear spoiler, against substantial movement with respect to the shell base 2, i.e., a rigidifying of the upper with respect to the shell base without the need of an additional element such as a separate latch between the upper 6 and the shell base 2.

Similarly to links 8, links 15 are arranged in connection with tensioning lever 7 on anchoring points 16 located on either side thereof. Links 15 are also in support in the guide corridors constituted by the .angle return plugs 17 obtained on rear spoiler 3.

Advantageously, front cuff 5 is provided to be relatively flexible so as to be able to flex in the direction of rear spoiler 3 during the tightening function, and especially to leave to the rear spoiler 3 the responsibility of ensuring restoring of rear support by means of links 15 which are hooked on anchoring point 18 obtained on the upper lateral portions 2*a* of shell base 2. For an optimum rear support quality, these lateral portions 2*a* are obviously provided to be rigid, even non-deformable, at least in the longitudinal direction of the boot. This boot construction enables the provision of a plurality of fixed points 18 for connecting links 15 on lateral portions 2*a* of shell base 2 in order to modify the position of closure of rear spoiler 3 and therefore the angle under which the rear spoiler is effective. These fixed points 18 are obtained sequentially to this end, on the lateral portions 2*a* and are preferably substantially centered on transverse journal axis 4 of rear spoiler 3. It is clear that for each angular position of rear spoiler 3, it is necessary to undertake a co-relational modification of the connecting positions of links 8 for tightening upper 6 on the lower part of the leg of the skier. On the other hand, any modification of the connecting of links 8 on anchoring points 10, 11 or 12 in order to vary the tightening of upper 3 on the lower part of the leg by bringing front cuff 5 closer towards rear spoiler 3 does not necessitate the adaptation of the length of links 15 for a given closure position of rear spoiler 3. Indeed, whatever the tightening being undertaken on the lower part of the leg, rearward support of rear spoiler 3 with respect to shell base 2 remains the same angularly.

In order to facilitate front cuff 5 coming closer towards rear spoiler 3 during tightening, front cuff 5 can advantageously be provided journalled on shell base 2 in the end zone of the boot and comprise lateral guide and linking means 32 with respect to the shell base. Further, in complement to the tightening function obtained in the upper portion of upper 6 by means of links 8, a strap 31 of a known type can be arranged to cross front cuff 5 in the in-step flexion fold zone and be connected along the flanks of shell base 2.

On the other hand, a loosening action of lever 7 in the direction F1 enables the upper 6 to be opened and pivoted freely forwardly so as to facilitate the skier's putting the boot on and walking with the loosened boot.

In addition, lever 7 thus arranged at the rear of the boot, does not constitute a disturbing protuberance, whatever its position.

Figure 2:
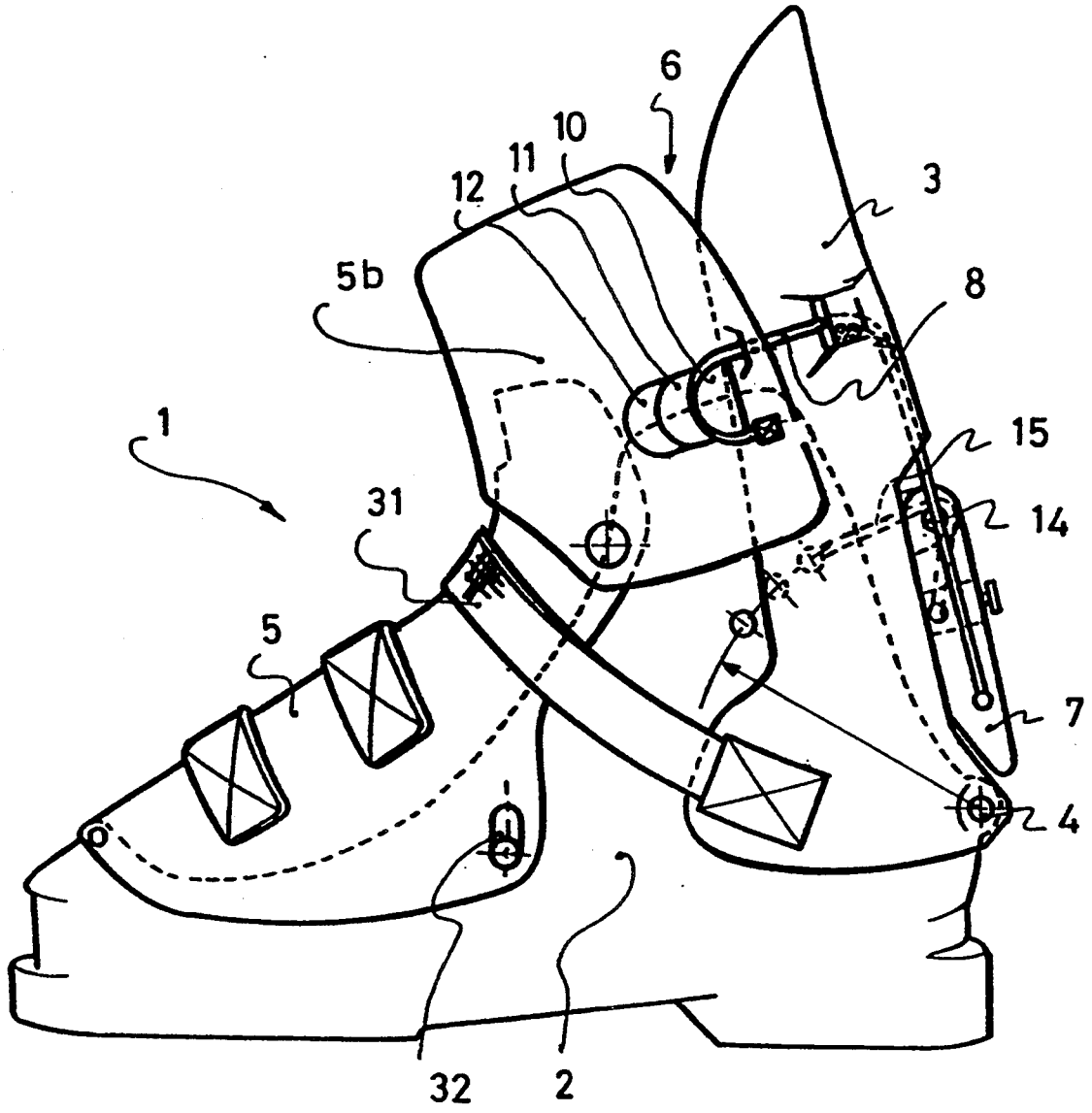
FIG. 2 is a side view of another ski boot comprising a device as per the invention.

In the example of the boot illustrated in FIG. 2, only the structures of the front portion 5 and of rear spoiler 3 of boot 6 differ from those described in FIG. 1. With regard to front portion 5, such portion is equipped with a pivoting cuff 5*b* in its upper zone corresponding to that of the lower part of the leg. This cuff 5*b* comprises the same anchoring points 10, 11 and 12 of links 8 as previously. Thus, when the tightening of the lower part of the leg is modified by means of links 8, cuff 5*b* pivots, simply, more or less towards rear spoiler 3. As regards rear spoiler 3, the latter comprises a strap 31 of a known type located in its lower portion on the lateral wings which cover the corresponding flanks of shell base 2, and extend above the front cuff 5 in a zone corresponding to the in-step/flexion fold zone.

Figure 3:
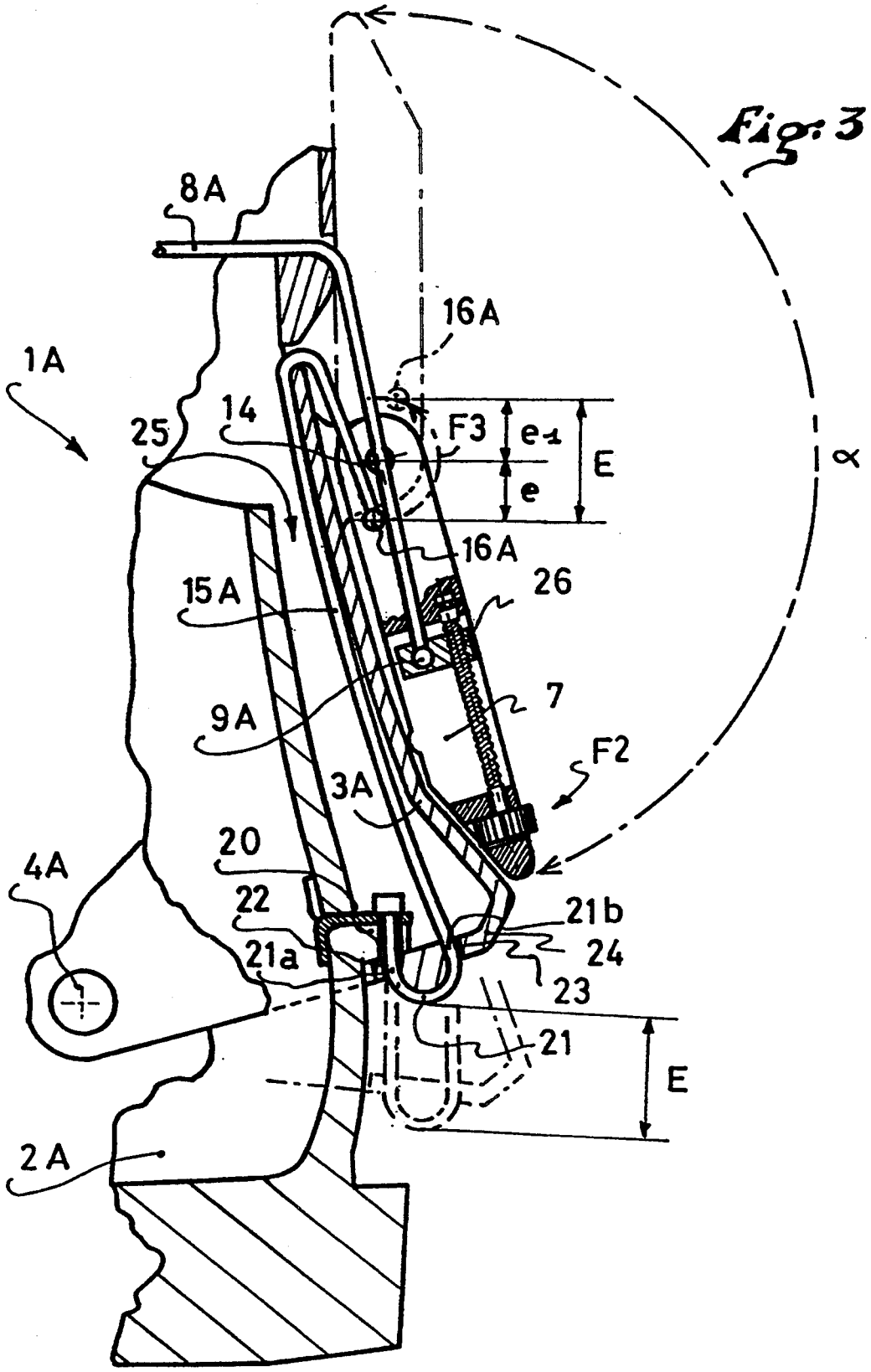
FIG. 3 is a partial view, in a vertical section at a larger scale, of a rear portion of a ski boot, as per a second embodiment of the invention.

According to a second embodiment of the invention represented in FIG. 3, the boot 1A basically differs from the previous in that the fixed point of shell base 2A is constituted by a rear edge 20 arranged in the heel zone and on which is anchored at least one link 15A for restoring rear support forming at its end a U-shaped loop 21 whose arms 21*a*, 21*b* successively cross in one direction then the other, two holes 22, 23 arranged on a shoulder 24 of rear spoiler 3A of the upper located under the rear edge 20 of shell base 2A and adapted to come into contact with the latter during a traction on link 15A by activating the lever 7.

As can be seen particularly well from FIG. 3, when lever 7 is in the latched position along direction F2, the tightening 8A and support restoring links 15A are tensioned to undertake their respective functions described hereinabove.

On the other hand, when the lever is pivoted in a direction F1, towards an unlatched position, there is an upward displacement along F3 of anchoring point 16A of links 15A according to a value equal to E="e"-+el":"e" being the distance between the journal point 14 of lever 7 and the anchoring point 16A of links 15A.

Thus, when lever 7 is in the unlatched position, rear spoiler 3A can pivot by a value E about journal point 4A. Links 8A and 15A consequently both take a certain slack equal to a value E for one as well as for the other.

The path of the links 8A and 15A is consequently directly proportionate to the value of the angular movement $\alpha$ of tensioning lever 7.

According to this configuration, link 15A for restoring rear support is housed in a longitudinal channel 25 defined in a rear portion of shell base 2A and the rear spoiler 3A on an external face of which is fixed the tensioning lever 7.

According to an improvement of the invention, the tightening links 8A of front cuff 5 are connected to tensioning lever 7 by means of a micrometric adjustment nut 26 controlled by a wheel so as to be able to modify the tightening tension on the lower part of the leg.

It must be noted in this regard that the device according to this embodiment thus enables the tightening value of upper on the lower part of the leg of the skier to be modified independently of the blocking position of rear spoiler 3A with respect to shell base 2A as in the example of FIG. 1.

Figure 4:
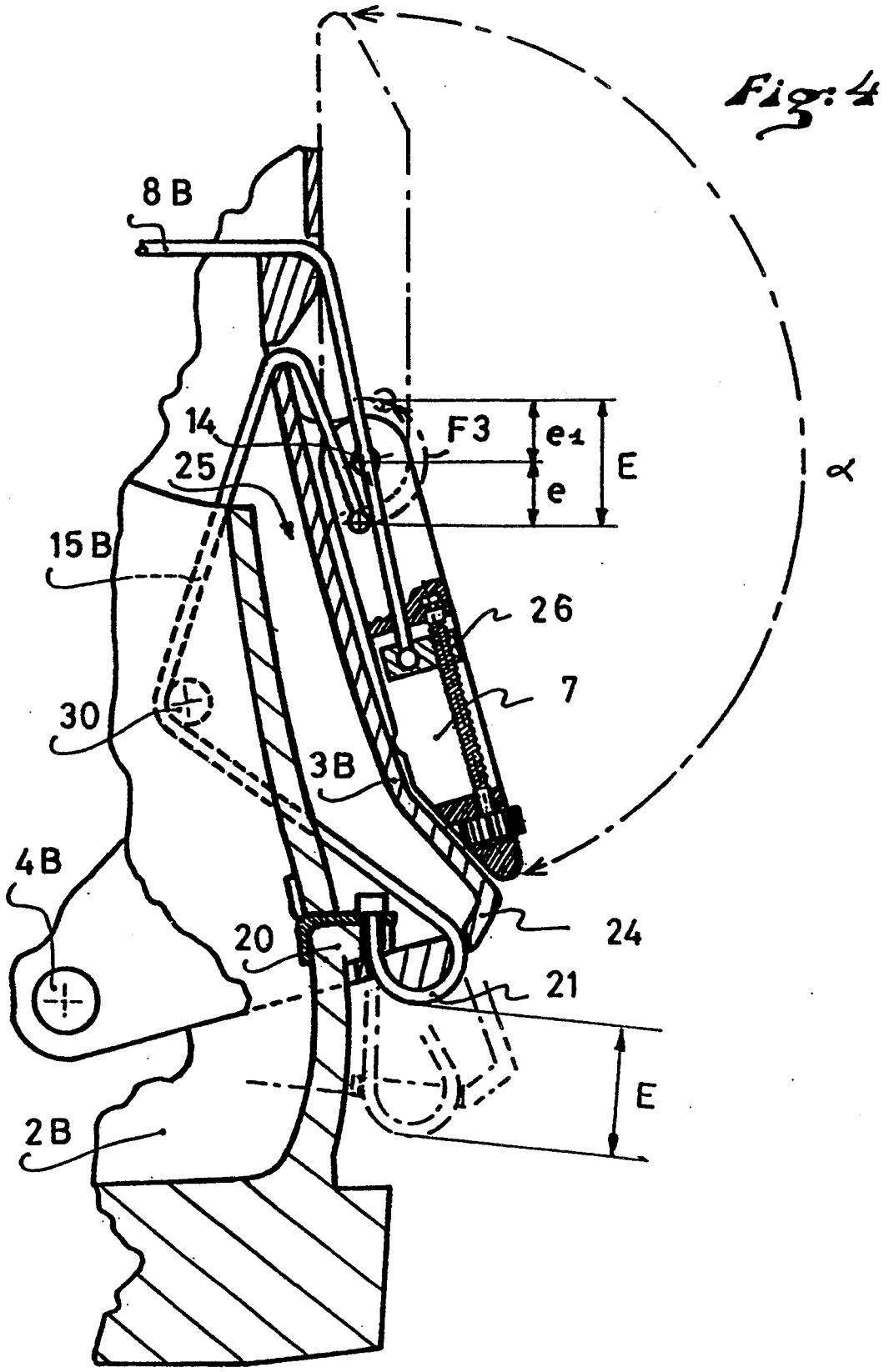
FIG. 4 is a variation of the embodiment of FIG. 2 according to a third example.

The variation represented in FIG. 4 basically differs from that of FIG. 3 in that the links 15B for restoring rear support are guided laterally by two fixed return plugs or numbers 30, arranged on either side of shell base 2B.

Naturally, in this case, the links do not pass through rear cavity 25.

Figure 5:
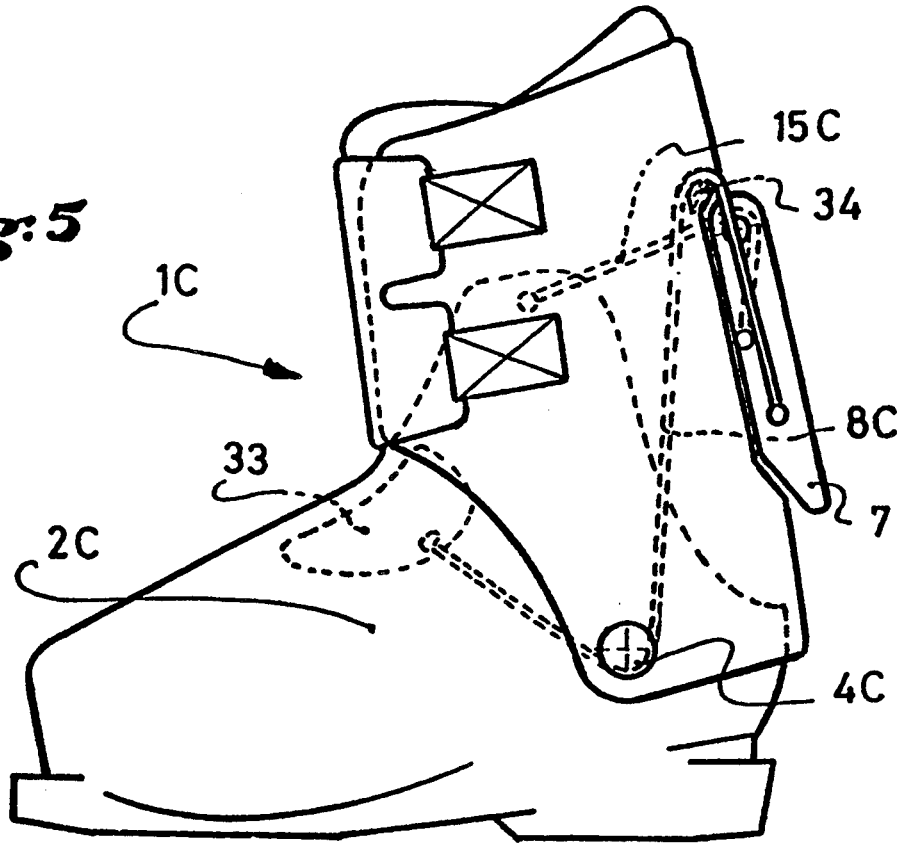
FIG. 5 is a side view of a boot showing a device for tightening an internal foot retention plate and a rear support restoring element according to a fourth example.

According to another example of the application of the invention represented in FIG. 5, the tightening links 8C control a front mobile portion of the boot 1C constituted, not by the front cuff of the upper, but by an internal foot retention plate 33 located beneath the upper portion of the fit of shell base 2C.

The guidance of tightening links 8C is undertaken by means of return plugs constituted by the transverse axis 4C located on the lateral portions of shell base 2C and return channels 34 obtained on the rear spoiler of upper 6C. As can be seen in the drawing, this can also be a collar forming the upper.

Figure 6:
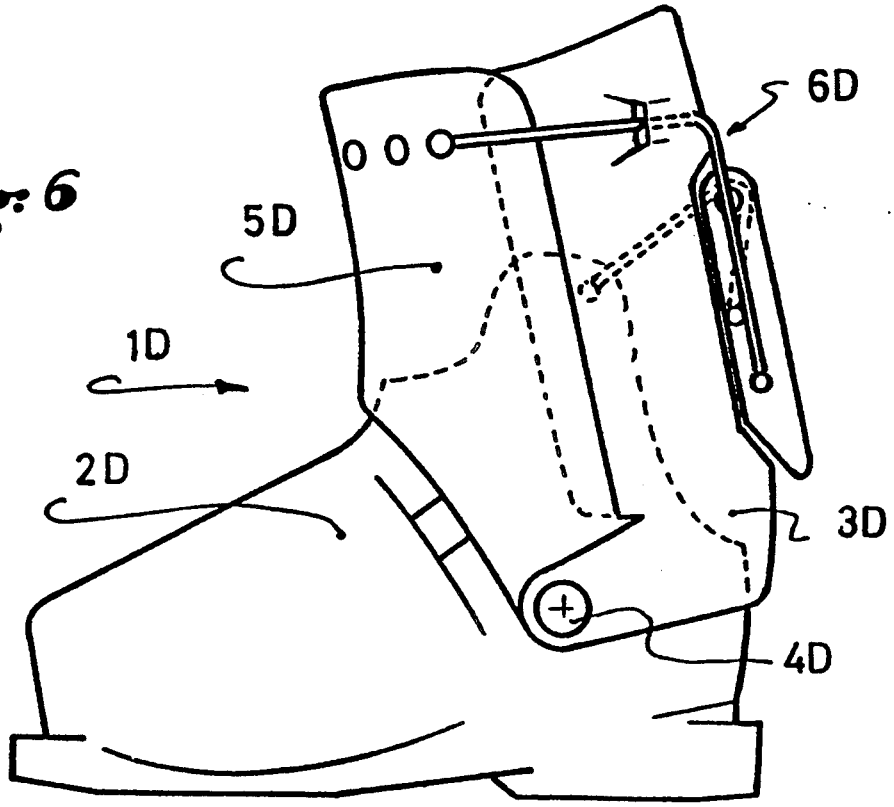
FIG. 6 illustrates a type of boot which is different from the previous ones, comprising the device as per the invention.

Still within the scope of the present invention, the boots can have structures that are different from those described herein above. Thus, boat 1D represented in FIG. 6 basically differs from the previous in that upper 6D is constituted by a rear spoiler 3D and a front cuff 5D journalled on shell base 2D by a common journal 4D.

Also, it is understood that other secondary arrangements can also be provided without leaving the scope of the invention. One can have, for example, links 8 and/or 15 which, rather than being provided with two ends, can be obtained with a single end. In this case, the anchoring points 9 and 16 located on tensioning lever 7 are constituted simply by transverse holes provided in the body of the lever 7 or by a slide adjustable in position on the latter.

The instant application is based upon French patent application 92.07762 of Jun. 22, 1992, the disclosure of which is hereby expressly incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed is:

1. An alpine ski boot comprising:

a shell base on which is journalled at least partially an upper constituted by at least one rear spoiler and a front cuff, the rear spoiler being journalled with respect to the shell base about a transverse axis and comprises a tensioning lever for applying a traction force on at least one flexible and inextensible link inserted between a front mobile portion of the boot to be controlled during tightening on a lower part of the leg and said lever, such lever also acting on an element for restoring rear support of the upper on the shell base, wherein the element for restoring rear support is constituted by at least one second flexible and inextensible link, distinct from the first inserted between the same tensioning lever and a fixed portion of the shell base such that application of said traction force by the tensioning lever causes, by simultaneous traction on the two links, both the tightening control of the front mobile portion of the boot for a first function, and restoring rear support of the upper on the shell base without an intermediate element for providing said rear support, to fulfill a second function.

2. An alpine ski boot comprising:

a shell base;

an upper extending upwardly from said shell base, said upper comprising at least one rear spoiler and a front cuff;

means for journalling said rear spoiler with respect to said shell base about a transverse axis;

a tensioning lever mounted on said upper for selective movement in a tensioning direction, to a latched position, and in a tension releasing direction, to an unlatched position;

at least one first flexible inextensible link extending from said tensioning lever to a forward movable portion of said boot, whereby said tensioning lever and said at least one first flexible inextensible link comprises a means for tightening said forward movable portion of said boot against the lower leg of a wearer of the boot; and at least one second flexible inextensible link extending from said tensioning lever to a fixed portion of said shell base, whereby said tensioning lever and said at least one second flexible inextensible link comprises a means for restoring rear support of said upper with respect to said shell base;

whereby said tensioning lever comprises means for simultaneously exerting traction on both said at least one first flexible inextensible link and said at least one second flexible inextensible link, as said tensioning lever is moved in said tensioning direction, for both (1) tightening said forward movable portion of said boot against the lower leg and (2) restoring rear support of said upper with respect to said shell base.

3. An alpine ski boot according to claim 2, wherein said means for restoring rear support of said upper with respect to said shell base consists of said tensioning lever and said at least one second flexible inextensible link.

4. An alpine ski boot according to claim 2, wherein:

said tensioning lever is mounted to said rear spoiler;

said at least one first flexible inextensible link comprise a pair of symmetrical links positioned on either lateral side of said tensioning lever, each of said pair of first links being anchored to said tensioning lever and being connected to said forward movable portion of said boot; and said at least one second flexible inextensible link comprise a pair of symmetrical links positioned on either lateral side of said tensioning lever, each of said pair of first links being anchored to said tensioning lever and being anchored to said shell base.

5. An alpine ski boot according to claim 2, further comprising:

a micrometric adjustment device mounted to said tensioning lever, said micrometric adjustment device comprising a screw extending along said tensioning lever and mounted for rotation with respect to said tensioning lever, a micrometric adjustment nut threadably received on said screw and a wheel attached to said screw for rotation of said screw and consequential movement of said nut, wherein said at least one first flexible inextensible link is connected to said adjustment nut, whereby said micrometric adjustment device comprises means for modifying tightening tension of said forward movable portion of said boot against the lower leg.

6. An alpine ski boot according to claim 2, further comprising:

a plurality of anchoring points for said at least one second flexible inextensible link on said fixed portion of said shell base for comprising a multi-position adjustment means for enabling adjustment of an angle of advance of said upper with respect to said shell base.

7. An alpine ski boot according to claim 2, wherein:

said forward movable portion of said boot comprises said front cuff.

8. An alpine ski boot according to claim 2, wherein:

said forward movable portion of said boot comprises an internal foot retention plate located beneath said upper and over the foot of the wearer of the boot.

9. An alpine ski boot according to claim 7, further comprising:

a plurality of anchoring points for said at least one first flexible inextensible link originating on said front cuff; and at least one guide channel on said rear spoiler, said at least one first flexible inextensible link being guided within respective said at least one guide channel.

10. An alpine ski boot according to claim 8, further comprising:

at least one return member located on at least one lateral portion of said shell base; and at least one return channel in said rear spoiler;

whereby said at least one first flexible inextensible link is guided by said at least one return and is guided within said at least one return channel.

11. An alpine ski boot according to claim 2, wherein:

said shell base comprises a pair of laterally opposed upwardly extending lateral portions; and said fixed portion of said shell base, to which said at least one second flexible inextensible link is connected, comprises one or both of said upwardly extending lateral portions.

12. An alpine ski boot according to claim 2, wherein:

said shell base comprises a rear edge arranged in a rear portion of said shell base;

said rear spoiler comprises a shoulder having a pair of holes therein, said rear spoiler being connected to said shell base in a manner so that said shoulder of said rear spoiler is positioned beneath and in engagement with said rear edge of said shell base in said latched position of said tensioning lever; and said fixed portion of said shell base, to which said second flexible inextensible link is connected, comprises said rear edge of said shell base, said at least one second flexible inextensible link extending from said rear edge of said shell base, downwardly through one of said pair of holes of said shoulder of said rear spoiler and upwardly through another of said pair of holes of said shoulder of said rear spoiler.

13. An alpine ski boot according to claim 12, wherein:

said at least one second flexible inextensible link is furthermore guided in a longitudinal channel defined said shell base and said tensioning lever.

14. An alpine ski boot according to claim 12, further comprising:

at least one return member located on at least one lateral portion of said shell base;

whereby said second flexible inextensible link is guided laterally by said at least one return member.

15. An alpine ski boot according to claim 2, further comprising:

means for journalling said tensioning lever in an angular movement on said upper for said selective movement of said tensioning lever between said tensioning direction and said tension releasing direction;

whereby said at least one first flexible inextensible link extending in a predetermined path, said predetermined path being proportionally defined by a value of said angular movement.

16. An alpine ski boot according to claim 2, wherein:

said at least one first flexible inextensible link terminates on said forward movable portion of said boot.

17. An alpine ski boot according to claim 2, wherein:

said at least one second flexible inextensible link terminates on said fixed portion of said shell base.

18. An alpine ski boot comprising:

a shell base;

an upper extending upwardly from said shell base, said upper comprising at least one rear spoiler and a front cuff;

a journalling means for enabling selective forward and rearward pivotal movement of said rear spoiler with respect to said shell base about a transverse axis;

a tensioning lever mounted on said upper for selective movement in a tensioning direction, to a latched position, and in a tension releasing direction;

at least one first flexible inextensible link extending from said tensioning lever to a forward movable portion of said boot, whereby said tensioning lever and said at least one first flexible inextensible comprises a means for tightening said forward movable portion of said boot against the lower leg of a wearer of the boot; and at least one second flexible inextensible link extending from said tensioning lever to a fixed portion of said shell base, whereby said tensioning lever and said at least one second flexible inextensible link comprises a means for blocking said rear spoiler with respect to said shell base;

whereby said tensioning lever comprises means for exerting traction on both said at least one first flexible inextensible link and said at least one second flexible inextensible link, as said tensioning lever is moved in said tensioning direction, for both (1) said tightening of said forward movable portion of said boot against the lower leg and (2) said blocking of said rear spoiler with respect to said shell base.

19. An alpine ski boot according to claim 18, wherein:

said means for blocking said rear spoiler with respect to said shell base consists of said tensioning lever and said at least one second flexible inextensible link.

20. An alpine ski boot according to claim 19, wherein: said movable portion of said boot comprises said front cuff.

21. An alpine ski boot according to claim 19, wherein: said forward movable portion of said boot comprises an internal foot retention plate located within said upper and over the foot of the wearer of the boot.

* * * * *